US007987616B2

(12) United States Patent
Bae et al.

(10) Patent No.: US 7,987,616 B2
(45) Date of Patent: Aug. 2, 2011

(54) LAUNDRY MACHINE

(75) Inventors: Sang Hun Bae, Changwon-si (KR); Chang Woo Son, Changwon-si (KR); Chul Jin Choi, Changwon-si (KR); Dong Hyun Kim, Changwon-si (KR); Young Bok Son, Changwon-si (KR); Heung Jae Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 944 days.

(21) Appl. No.: 11/980,735

(22) Filed: Oct. 31, 2007

(65) Prior Publication Data

US 2008/0141554 A1 Jun. 19, 2008

(30) Foreign Application Priority Data

Dec. 15, 2006 (KR) ..... 10-2006-0128696

(51) Int. Cl.
*F26B 11/00* (2006.01)

(52) U.S. Cl. ..... 34/601; 34/602; 34/606; 34/610; 34/68; 705/14; 8/158; 8/159; 68/18 R; 68/5 R; 134/130; 134/160; 510/349; 510/101; 219/389

(58) Field of Classification Search ..... 34/68, 601, 34/602, 606, 610; 68/18 R, 5 R; 8/158, 159; 705/14; 134/130, 132; 510/101, 349; 219/389
See application file for complete search history.

(56) References Cited

U.S. PATENT DOCUMENTS

| | | | | | |
|---|---|---|---|---|---|
| 1,957,937 | A * | 5/1934 | Campbell et al. | ..... | 162/19 |
| 2,114,776 | A * | 4/1938 | Davis | ..... | 68/18 R |
| 2,260,282 | A * | 10/1941 | Grint | ..... | 156/148 |
| 2,452,858 | A * | 11/1948 | Miller | ..... | 264/605 |
| 2,528,476 | A * | 10/1950 | Roos et al. | ..... | 34/292 |
| 3,686,900 | A * | 8/1972 | Sando et al. | ..... | 68/5 E |
| 3,768,281 | A * | 10/1973 | Sando et al. | ..... | 68/5 E |
| 4,974,339 | A * | 12/1990 | Kawamura et al. | ..... | 34/73 |
| 5,827,329 | A * | 10/1998 | Champeau | ..... | 8/142 |
| 5,953,939 | A * | 9/1999 | Guerrero-Parra et al. | ..... | 68/23.3 |
| 6,221,826 | B1 * | 4/2001 | Surutzidis et al. | ..... | 510/349 |
| 6,684,440 | B1 * | 2/2004 | Wise et al. | ..... | 8/158 |
| 6,790,814 | B1 * | 9/2004 | Marin et al. | ..... | 510/101 |
| 7,316,781 | B2 * | 1/2008 | Radomyselski et al. | ..... | 210/631 |
| 7,367,206 | B2 * | 5/2008 | Asada et al. | ..... | 68/18 F |
| 7,481,082 | B2 * | 1/2009 | Cho et al. | ..... | 68/17 R |
| 7,490,493 | B2 * | 2/2009 | Kim et al. | ..... | 68/15 |
| 7,520,146 | B2 * | 4/2009 | Kim et al. | ..... | 68/15 |
| 7,584,633 | B2 * | 9/2009 | Kim et al. | ..... | 68/5 R |
| 7,661,169 | B2 * | 2/2010 | Kim et al. | ..... | 8/159 |
| 7,735,345 | B2 * | 6/2010 | Wright et al. | ..... | 68/13 R |
| 7,875,833 | B2 * | 1/2011 | Song | ..... | 219/389 |

(Continued)

FOREIGN PATENT DOCUMENTS

DE 102008047283 * 4/2010

(Continued)

*Primary Examiner* — Steve Gravini
(74) *Attorney, Agent, or Firm* — McKenna Long & Aldridge LLP

(57) ABSTRACT

The present invention relates to a laundry machine. The laundry machine includes a drum rotatably mounted in a cabinet, a hot air heater to heat air and supply hot air into the drum, a steam generator to supply steam into the drum, a water supply source detachably mounted in the cabinet to supply water into the steam generator, and a water leakage preventing unit to prevent water leakage when the water supply source is detachably mounted.

15 Claims, 15 Drawing Sheets

U.S. PATENT DOCUMENTS 7,895,770 B2 * 3/2011 Bae et al. ..... 34/595
7,905,120 B2 * 3/2011 Mamiya et al. ..... 68/5 C
7,908,895 B2 * 3/2011 Kwon et al. ..... 68/17 R
7,934,279 B2 * 5/2011 Son ..... 8/158
2003/0045446 A1 * 3/2003 Dihora et al. ..... 510/320
2004/0065125 A1 * 4/2004 Asada et al. ..... 68/12.09
2004/0187527 A1 * 9/2004 Kim et al. ..... 68/5 C
2004/0187529 A1 * 9/2004 Kim et al. ..... 68/207
2004/0237603 A1 * 12/2004 Kim et al. ..... 68/15
2004/0262570 A1 * 12/2004 Radomyselski et al. ..... 252/180
2005/0009715 A1 * 1/2005 Marin et al. ..... 510/101
2005/0199016 A1 * 9/2005 Tadano et al. ..... 68/18 C
2005/0223504 A1 * 10/2005 Lee et al. ..... 8/158
2005/0229652 A1 * 10/2005 Kim et al. ..... 68/237
2005/0241347 A1 * 11/2005 Cho et al. ..... 68/243
2006/0005581 A1 * 1/2006 Banba ..... 68/5 R
2006/0059956 A1 * 3/2006 Zardetto ..... 68/3 R
2006/0191078 A1 * 8/2006 Kim et al. ..... 8/159
2007/0028398 A1 * 2/2007 Kwon et al. ..... 8/158
2007/0107472 A1 * 5/2007 Kim et al. ..... 68/5 R
2007/0136956 A1 * 6/2007 Kim et al. ..... 8/149.3
2007/0137262 A1 * 6/2007 Kim et al. ..... 68/5 R
2007/0151310 A1 * 7/2007 Wright et al. ..... 68/3 R
2008/0000098 A1 * 1/2008 Choi et al. ..... 34/114
2008/0053166 A1 * 3/2008 Lim ..... 68/5 C
2008/0092928 A1 * 4/2008 Wong et al. ..... 134/30
2008/0115381 A1 * 5/2008 Bae et al. ..... 34/60
2008/0141550 A1 * 6/2008 Bae et al. ..... 34/68
2008/0141552 A1 * 6/2008 Bae et al. ..... 34/108
2008/0141553 A1 * 6/2008 Son et al. ..... 34/130
2008/0141554 A1 * 6/2008 Bae et al. ..... 34/132
2008/0141557 A1 * 6/2008 Son et al. ..... 34/565
2008/0141558 A1 * 6/2008 Bae et al. ..... 34/595
2008/0141734 A1 * 6/2008 Son et al. ..... 68/5 C
2008/0148494 A1 * 6/2008 Son et al. ..... 8/149.3
2008/0148596 A1 * 6/2008 Son et al. ..... 34/486
2008/0168679 A1 * 7/2008 Son et al. ..... 34/497
2008/0168805 A1 * 7/2008 Kim et al. ..... 68/5 C
2008/0256989 A1 * 10/2008 Jeong et al. ..... 68/5 C
2008/0271263 A1 * 11/2008 Bae et al. ..... 8/159
2008/0276381 A1 * 11/2008 Son ..... 8/149.3
2008/0276659 A1 * 11/2008 Bae et al. ..... 68/5 C
2008/0276660 A1 * 11/2008 Bae et al. ..... 68/5 C
2008/0276661 A1 * 11/2008 Bae et al. ..... 68/5 C
2008/0282751 A1 * 11/2008 Yoon et al. ..... 68/5 C
2008/0289212 A1 * 11/2008 Moon et al. ..... 34/267
2008/0302138 A1 * 12/2008 Bae et al. ..... 68/12.05
2008/0313922 A1 * 12/2008 Bae et al. ..... 34/491
2009/0007601 A1 * 1/2009 Suzuki et al. ..... 68/13 R
2009/0049872 A1 * 2/2009 Noro et al. ..... 68/18 C
2009/0049874 A1 * 2/2009 Mamiya et al. ..... 68/5 C
2009/0072683 A1 * 3/2009 Song et al. ..... 312/228
2009/0078007 A1 * 3/2009 Bae et al. ..... 68/5 C
2009/0083988 A1 * 4/2009 Yoon et al. ..... 34/130
2009/0083990 A1 * 4/2009 Bae et al. ..... 34/486
2009/0090388 A1 * 4/2009 Kim et al. ..... 134/18
2009/0100882 A1 * 4/2009 Bae et al. ..... 68/5 C
2009/0107188 A1 * 4/2009 Park ..... 68/5 R
2009/0113745 A1 * 5/2009 Choi et al. ..... 34/139
2009/0113755 A1 * 5/2009 Choi et al. ..... 34/390
2009/0120140 A1 * 5/2009 Choi et al. ..... 68/5 C
2009/0126222 A1 * 5/2009 Bae et al. ..... 34/527
2009/0126423 A1 * 5/2009 Bae et al. ..... 68/5 C
2009/0133281 A1 * 5/2009 Yoon et al. ..... 34/72
2009/0172967 A1 * 7/2009 Son et al. ..... 34/318
2009/0199424 A1 * 8/2009 Bae et al. ..... 34/60
2009/0235553 A1 * 9/2009 Bae et al. ..... 34/524
2009/0249840 A1 * 10/2009 Jo et al. ..... 68/5 C
2009/0255299 A1 * 10/2009 Hiro et al. ..... 68/19
2009/0260246 A1 * 10/2009 Bae et al. ..... 34/60
2009/0260404 A1 * 10/2009 Saito et al. ..... 68/20
2009/0265953 A1 * 10/2009 Bae et al. ..... 34/467
2009/0277035 A1 * 11/2009 Choi et al. ..... 34/130
2009/0277037 A1 * 11/2009 Lim ..... 34/215
2009/0288456 A1 * 11/2009 Bae et al. ..... 68/5 R
2009/0307921 A1 * 12/2009 Bae et al. ..... 34/60
2009/0320213 A1 * 12/2009 Lee et al. ..... 8/159
2009/0320313 A1 * 12/2009 Bae et al. ..... 34/132
2009/0320317 A1 * 12/2009 Bae et al. ..... 34/282
2010/0000117 A1 * 1/2010 Choi et al. ..... 34/443
2010/0005681 A1 * 1/2010 Jo et al. ..... 34/215
2010/0050464 A1 * 3/2010 Krzelowski et al. ..... 34/380
2010/0058610 A1 * 3/2010 Kim et al. ..... 34/474
2010/0065086 A1 * 3/2010 Cho ..... 134/19
2010/0077628 A1 * 4/2010 Bae et al. ..... 34/60
2010/0095716 A1 * 4/2010 Bae et al. ..... 68/5 R
2010/0115784 A1 * 5/2010 Jo et al. ..... 34/132
2010/0139334 A1 * 6/2010 Kim et al. ..... 68/5 C
2010/0154250 A1 * 6/2010 Bae et al. ..... 34/549
2010/0186176 A1 * 7/2010 Wright et al. ..... 8/137
2010/0206016 A1 * 8/2010 Bae et al. ..... 68/5 C
2010/0281929 A1 * 11/2010 Han et al. ..... 68/5 C
2010/0300154 A1 * 12/2010 Nakamura et al. ..... 68/13 R
2011/0113642 A1 * 5/2011 Bae et al. ..... 34/60

FOREIGN PATENT DOCUMENTS

EP 434169 A2 * 6/1991
EP 548386 A1 * 6/1993
EP 1275767 * 1/2003
EP 1507028 A1 * 2/2005
EP 1507029 A 2/2005
EP 1507032 A1 * 2/2005
EP 1507033 A1 * 2/2005
EP 1657345 A2 * 5/2006
EP 1657348 A2 * 5/2006
EP 1845184 A 10/2007
EP 1865098 A1 * 12/2007
GB 2307277 A * 5/1997
JP 54084890 A * 7/1979
JP 54117394 A * 9/1979
JP 56034013 A * 4/1981
JP 57122106 A * 7/1982
JP 59221410 A * 12/1984
JP 60187387 A * 9/1985
JP 61207493 A * 9/1986
JP 62076162 A * 4/1987
JP 01111102 A * 4/1989
JP 01174853 A * 7/1989
JP 02033568 A * 2/1990
JP 03019956 A * 1/1991
JP 04008398 A * 1/1992
JP 05113108 A * 5/1993
JP 06042369 A * 2/1994
JP 06319896 A * 11/1994
JP 07000689 A * 1/1995
JP 08082477 A * 3/1996
JP 08103596 A * 4/1996
JP 08173688 A * 7/1996
JP 08252395 A * 10/1996
JP 09094388 A * 4/1997
JP 09173697 A * 7/1997
JP 10196401 A * 7/1998
JP 11344203 A * 12/1999
JP 2000213701 A * 8/2000
JP 2004057235 A * 2/2004
WO WO 2006/126803 A 11/2006
WO WO 2007145432 A1 * 12/2007
WO WO 2007145448 A2 * 12/2007
WO WO 2008010671 A2 * 1/2008
WO WO 2008013426 A2 * 1/2008

* cited by examiner

LAUNDRY MACHINE

This application claims the benefit of Korean Patent Application No. 10-2006-0128696, filed on Dec. 15, 2006, which is hereby incorporated by reference in its entirety as if fully set forth herein.

BACKGROUND OF THE INVENTION

1. Field of the Invention

The present invention relates to a laundry machine, and more particularly, to a steam laundry dryer which can prevent generation of water leakage in the steam laundry dryer.

2. Discussion of the Related Art

Laundry dryers are typically electric appliances that dry washed laundry, mainly washed clothes, by using high temperature air. In general, a laundry dryer is configured of a drum, a driving source, heating means and a blower unit. Laundry is held in the drum, and the driving source drives the drum. The heating means heats air drawn into the drum. The blower unit sucks air into the drum, or discharges air outside the drum.

Laundry dryers may be categorized, based on a method of heating air, i.e., heating means, into electric type laundry dryers and gas type laundry dryers. In an electric type laundry dryer, air is heated by using electric resistance heat. In a gas type laundry dryer, air is heated by using heat generated from gas combustion. On the other hand, laundry dryers may be categorized into condensation type laundry dryers and exhaustion type laundry dryers. In a condensation type laundry dryer, air is heat-exchanged with laundry in the drum and the damp air is circulated without being discharged outside the laundry dryer, to be heat-exchanged with external air at an auxiliary condenser. At this time, condensed water is generated and discharged outside. In an exhaustion type laundry dryer, air is heat-exchanged with laundry in the drum and the damp air is directly discharged outside the laundry dryer. Further, laundry dryers may be categorized, based on a method of loading laundry, into top loading type laundry dryers and front loading type laundry dryers. In a top loading type laundry dryer, laundry is loaded into the drum through a top of the laundry dryer. In a front loading type laundry dryer, laundry is loaded into the drum through a front of the laundry dryer.

However, the above conventional laundry dryers have the following problems.

Commonly, the washed and dehydrated laundry is loaded and dried in the laundry dryer. In view of a principle of water washing, the washed laundry has wrinkles, and the wrinkles are not removed during a drying process in the laundry dryer. As a result, the conventional laundry dryer has a shortcoming that a user should iron out the dried laundry to remove the wrinkles.

Moreover, in case that clothes besides the washed laundry are kept and used, the clothes may have wrinkles, crumples and fold marks (hereinafter, commonly referred to as "wrinkles"). Accordingly, there have been demands for development of devices capable of also easily removing the wrinkles generated by the common usage and keeping of the clothes.

SUMMARY OF THE INVENTION

Accordingly, the present invention is directed to a steam laundry dryer that substantially obviates one or more problems due to limitations and disadvantages of the related art.

An object of the present invention is to provide a steam laundry dryer that can remove wrinkles of laundry.

Another object of the present invention is to provide a steam laundry dryer that can prevent generation of water leakage in the steam laundry dryer.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a steam laundry dryer comprises: a drum rotatably mounted in a cabinet; a hot air heater to heat air and supply hot air into the drum; a steam generator to supply steam into the drum; a water supply source detachably mounted in the cabinet to supply water into the steam generator; and a water leakage preventing unit to prevent water leakage when the water supply source is detachably mounted.

The steam generator is to generate steam to supply into the drum. Instead of the steam generator, other device can be used as long as the device is appropriate to supply fine droplets of water into the drum. For example, a spray nozzle can be used to supply fine droplets of water. The spray nozzle is well known as a nozzle which turns water into fine droplets of water. The spray nozzle can be mounted at a location, like a rear support for the drum, appropriate to supply the fine droplets into the drum and connected to the water supply source by a hose.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention associated with a steam laundry dryer, examples of which are illustrated in the accompanying drawings. Wherever possible, the same reference numbers will be used throughout the drawings to refer to the same or like parts. For convenience of explanation of a steam laundry dryer according to the present invention, a top loading type, electric type and condensation type laundry dryer will be exemplified. However, the present invention is not limited to the above example, and also can be applied to a front loading type, gas type and condensation type laundry dryer.

Figure 1:
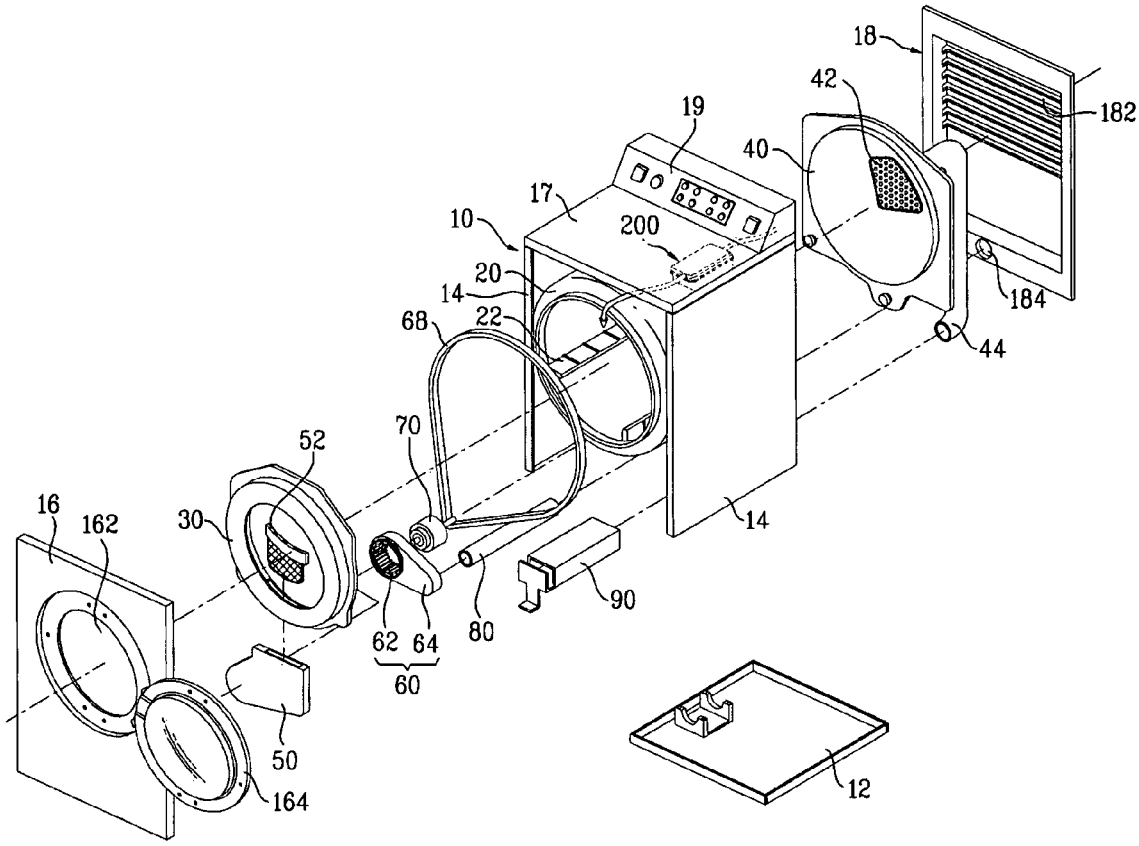
FIG. 1 is an exploded perspective view illustrating a steam laundry dryer in accordance with an exemplary embodiment of the present invention.
Figure 2:
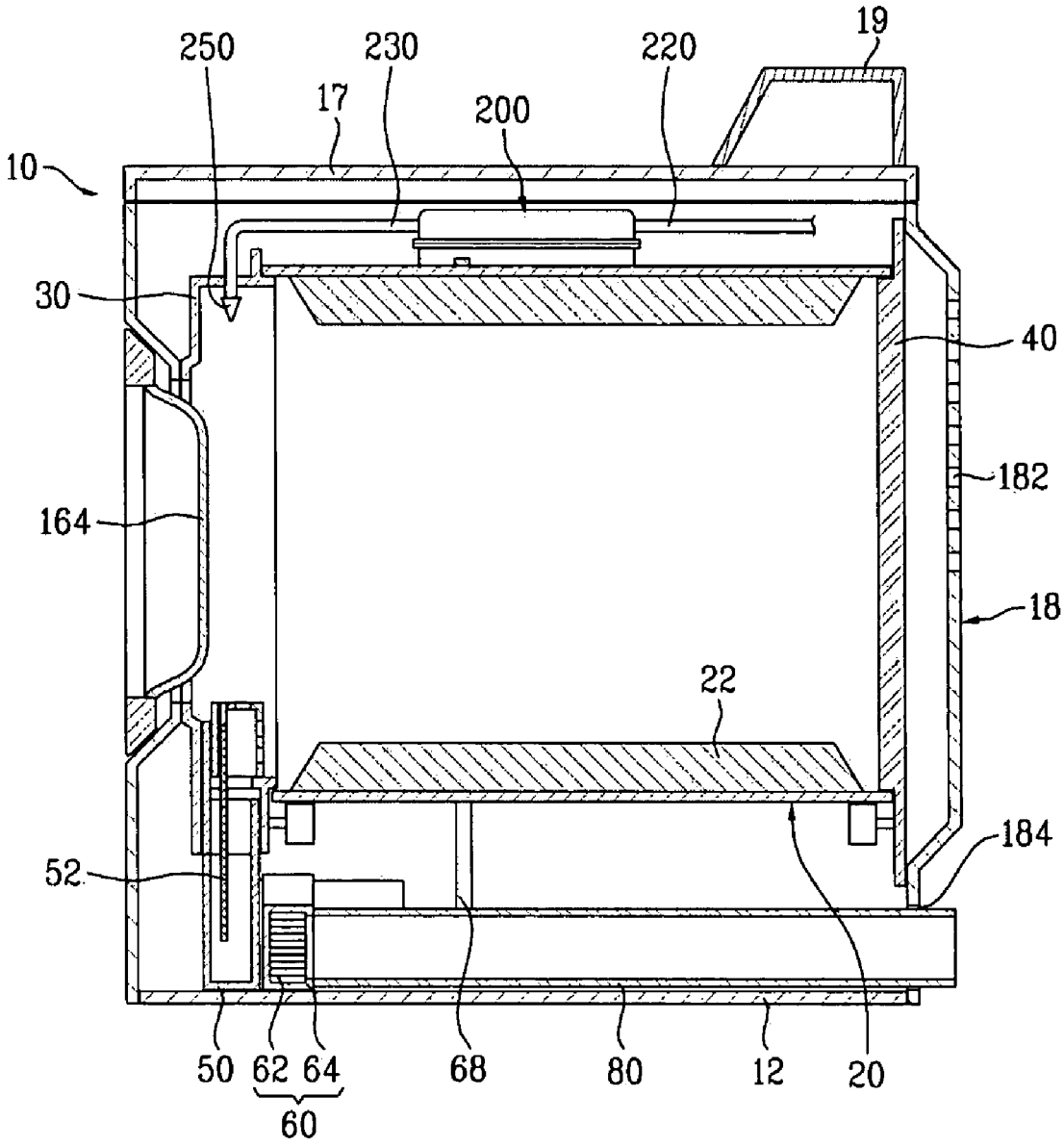
FIG. 2 is a longitudinal-sectional view of FIG. 1.

FIG. 1 is an exploded perspective view illustrating a steam laundry dryer in accordance with an exemplary embodiment of the present invention, and FIG. 2 is a longitudinal-sectional view of FIG. 1.

A steam laundry dryer according to an exemplary embodiment of the present invention will now be described with reference to FIGS. 1 and 2.

A cabinet 10 defines an exterior appearance of the steam laundry dryer according to the present invention, and houses components described below. Inside the cabinet 10 are mounted a rotatable drum 20, and a motor 70 and a belt 68 to drive the drum 20. A heater 90 (hereinafter, referred to as "hot air heater") is mounted in a predetermined portion of the cabinet 10 to create air of a high temperature (hereinafter, referred to as "hot air") by heating the air. A hot air supply duct 44 is mounted in a predetermined portion of the cabinet 10 to supply the hot air generated from the hot air heater 90 into the drum 20. Also, there are provided an exhaustion duct 80 and a blower unit 60 in the cabinet 10. The damp air heat-exchanged with the laundry in the drum 20 is discharged outside the drum 20 through the exhaustion duct 80, and the damp air is sucked by the blower unit 60. A steam generator 200 is mounted in a predetermined portion of the cabinet 10 to generate steam of a high temperature.

For convenience of explanation, this embodiment shows and describes an indirect drive type such that the drum 20 is rotated by the motor 70 and the belt 68, however the present invention is not limited thereto. In other words, the present invention also can be applied to a direct drive type such that the drum 20 is directly rotated by directly connecting the motor to a rear surface of the drum 20.

The aforesaid components will now be explained in detail.

The cabinet 10 defining the exterior appearance of the laundry dryer includes a base 12 forming a bottom surface, a pair of side covers 14 vertically mounted to the base 12, a front cover 16 mounted to front surfaces of the side covers 14, a rear cover 18 mounted to rear surfaces of the side covers 14, and a top cover 17 mounted to top surfaces of the side covers 14. A control panel 19 having various operational switches is positioned on the top cover 17 or the front cover 16, and a door 164 is coupled to the front cover 16. An air inlet 182 and an air outlet 184 are provided at the rear cover 18. External air is drawn through the air inlet 182, and the air in the drum 20 is discharged outside through the air outlet 184 that is a final path to the outside.

An inner space of the drum 20 is employed as a drying chamber for drying the laundry. It is preferred that a lifter 22 is installed in the drum 20 to lift and drop the laundry, so that the laundry is turned over to enhance drying efficiency.

A front supporter 30 and a rear supporter 40 are provided between the drum 20 and the cabinet 10. More particularly, the front supporter 30 is provided between the drum 20 and the front cover 16, and the rear supporter 40 is provided between the drum 20 and the rear cover 18. The drum 20 is rotatably mounted between the front supporter 30 and the rear supporter 40, and sealing members (not shown) for preventing water leakage are provided between the front supporter 30 and the drum 20 and between the drum 20 and the rear supporter 40. The front supporter 30 and the rear supporter 40 shield a front surface and a rear surface of the drum 20, respectively, to form the drying chamber and support a front end and a rear end of the drum 20.

An opening is formed at the front supporter 30 to communicate the drum 20 with the outside of the laundry dryer. The opening is selectively opened and closed by the door 164. A lint duct 50, through which the air in the drum 20 flows outside, is connected to the front supporter 30, and a lint filter 52 is installed at the lint duct 50.

A portion of the blower unit 60 is connected to the lint duct 50, and an opposite portion of the blower unit 60 is connected to the exhaustion duct 80. The exhaustion duct 80 is in communication with the air outlet 184 provided at the rear cover 18.

Accordingly, if the blower unit 60 operates, the air in the drum 20 flows through the lint duct 50, the exhaustion duct 80 and the air outlet 184 in order, and is discharged outside. At this time, foreign substances including lint are filtered by the lint filter 52. The blower unit 60 typically consists of a blower 62 and a blower housing 64. The blower 62 is commonly connected to the motor 70 for driving the drum 20.

An opening portion 42 including a plurality of through-holes is formed at the rear supporter 40, and the hot air supply duct 44 is connected to the opening portion 42. The hot air supply duct 44 is in communication with the drum 20, and is employed as a path for supplying hot air into the drum 20. For this, the hot air heater 90 is mounted in a predetermined portion of the hot air supply duct 44.

The steam generator 200 is mounted in a predetermined portion of the cabinet 10 to generate steam and supply the steam into the drum 20.

Figure 3:
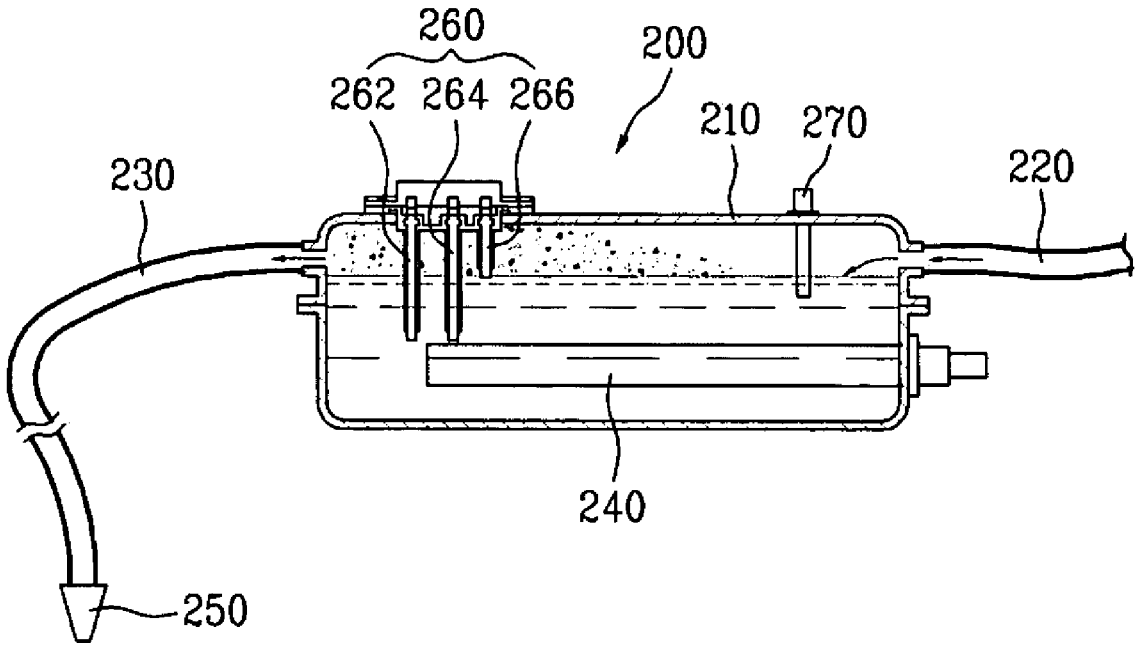
FIG. 3 is a sectional view illustrating a steam generator shown in FIG. 1.

FIG. 3 is a sectional view illustrating the steam generator shown in FIG. 1. The steam generator 200 will now be explained in detail with reference to FIG. 3.

The steam generator 200 includes a water tank 210 to store water therein, a heater 240 mounted in the water tank 210, a water level sensor 260 to detect a water level in the steam generator 200, and a temperature sensor 270 to detect a temperature of the steam generator 200. The water level sensor 260 includes a common electrode 262, a low water level electrode 264 and a high water level electrode 266. A high water level is sensed based on whether an electric current is applied between the common electrode 262 and the high water level electrode 266, and a low water level is sensed based on whether an electric current is applied between the common electrode 262 and the low water level electrode 264.

A water supply hose 220 is connected to a portion of the steam generator 200 to supply water, and a steam hose 230 is connected to an opposite portion of the steam generator 200 to discharge steam. It is preferred that a nozzle 250 having a predetermined shape is provided at a front end of the steam hose 230. An end of the water supply hose 220 is typically connected to an external water supply source such as a water tap. The front end of the steam hose 230 or the nozzle 250, that is, a steam outlet is positioned at a predetermined portion of the drum 20 to spray steam into the drum 20.

Although this embodiment shows and describes the steam generator 200 in which the heater 240 heats the water in the water tank 210 to generate steam (hereinafter, referred to as "tank heating type steam generator" for convenience of explanation), the present invention is not limited thereto. In other words, any device capable of generating steam may be used as the steam generator in the present invention. For example, a steam generator in which a heater is directly installed around a water supply hose to heat the water flowing through the water supply hose, without storing water in a predetermined space, (hereinafter, referred to as "pipe heating type steam generator" for convenience of explanation) may be applicable to the present invention.

Figure 4:
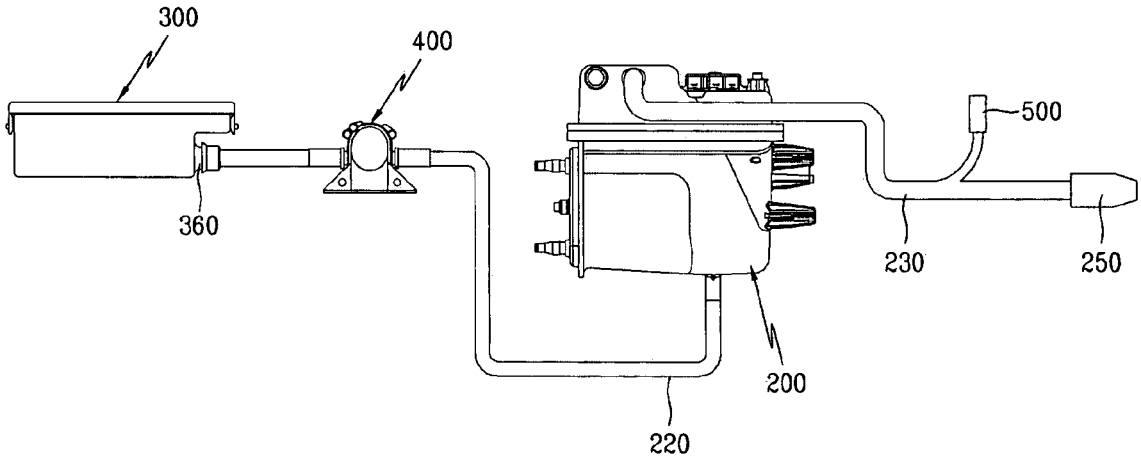
FIG. 4 is a schematic view illustrating a steam generator of a steam laundry dryer in accordance with another exemplary embodiment of the present invention.

FIG. 4 is a schematic view illustrating a steam generator of a steam laundry dryer in accordance with another exemplary embodiment of the present invention. A steam laundry dryer according to another embodiment of the present invention will now be described with reference to FIG. 4.

In this embodiment, a water supply source for supplying water to the steam generator 200 is detachably mounted. The water supply source may be configured as a water tap as described in the previous embodiment. However, in such a case, the installation becomes complicated. This is because the laundry dryer does not commonly use water, if the water tap is used as the water supply source, various devices annexed thereto should be additionally installed. Accordingly, this embodiment using a detachable water supply source 300 is very convenient in use. In other words, the water supply source 300 is detached from the laundry dryer to be filled with water, and then the water supply source 300 filled with water is connected to a water supply passage of the steam generator 200, i.e., the water supply hose 220.

It is preferred that a pump 400 is provided between the water supply source 300 and the steam generator 200. More preferably, the pump 400 can rotate in a forward direction and a reverse direction, so as to supply water into the steam generator 200 or collect residual water in the steam generator 200 as needed.

It also may be possible to supply water into the steam generator 200 by using a difference in water column heights between the water supply source 300 and the steam generator 200, without using the pump 400. However, because the components of the steam laundry dryer are typically standardized and designed compactly, a structural space is absolutely small. Therefore, if sizes of the components of the conventional laundry dryer are not changed, the water supply using the difference in water column heights is practically impossible. As a result, it is very useful to use the compact pump 400, because the steam generator 200 can be installed without changing sizes of the components of the conventional laundry dryer. Here, the reason for collecting residual water in the steam generator 200 is that if the steam generator 200 is not used for a long period, the heater may be damaged by the residual water or rotten water may be used in the following operation.

While the previous embodiment is configured such that the water supply and the steam exhaustion are achieved through the upper portion of the steam generator 200, this embodiment is configured such that water is supplied through the lower portion of the steam generator 200 and steam is exhausted through the upper portion of the steam generator 200. Such a configuration of this embodiment is effective to collect residual water in the steam generator 200. Also, it is preferred that a safety valve 500 is provided at a steam passage for discharging steam from the steam generator 200, i.e., the steam hose 230.

Hereinafter, the respective components will be explained in detail with reference to the drawings.

First, the detachable water supply source 300 (hereinafter, referred to as "cartridge" for convenience of explanation) will be explained in detail with reference to FIG. 5.

The cartridge 300 includes a lower housing 310 to substantially store water therein, and an upper housing 320 detachably coupled to the lower housing 310. If the cartridge 300 is composed by the lower housing 310 and the upper housing 320, it is easy to clean out dirt of water in the cartridge 300 and to dismantle filters 330 and 340 and a water softening member 350 (which will be described later) to clean and reuse them.

It is preferred that a first filter 330 is mounted to the upper housing 320. In other words, the first filter 330 is mounted to a water inlet 322 of the upper housing 320, to firstly filter the water supplied into the cartridge 300.

A first opening/closing member 360 (refer to FIG. 6) is provided at the lower housing 310 to selectively supply water in the cartridge 300 to the outside. When the cartridge 300 is detached, the first opening/closing member 360 blocks the water from being discharged outside the cartridge 300. When the cartridge 300 is installed, the first opening/closing member 360 permits the water to be discharged outside the cartridge 300. It is also preferred that a second filter 340 for filtering water is connected to the first opening/closing member 360. It is more preferred that the second filter 340 is detachably provided. A concrete constitution of the first opening/closing member 360 will be explained in detail later.

By using the first filter 330 and the second filter 340, impurities, such as micro dust, contained in water can be filtered off twice. It is preferable to use the first filter 330 having about 50 mesh nets and the second filter 340 having about 60 mesh nets. Here, the 50 mesh nets refer to that the number of mesh per a predetermined area is 50. Accordingly, since a size of an air hole composing the mesh of the first filter 330 is larger than a size of an air hole composing the mesh of the second filter 340, the relatively large foreign substances are firstly filtered off by the first filter 330, and the relatively small foreign substances are secondarily filtered off by the second filter 340.

It is also preferred that a water softening member 350 for softening water is provided in the cartridge 300. It is more preferred that the water softening member 350 is detachably provided.

The reason for using the water softening member 350 is as follows. If hardness of water supplied into the steam generator 200 is high, when calcium hydrogen carbonate (Ca (HCO3)2) dissolved in water is heated, lime (calcium carbobate (CaCO3)) is educed, which may cause corrosion of the heater. Especially, such a phenomenon is accelerated in the European and American continents in which hard water having high hardness is used. Accordingly, it is preferable to prevent the eduction of the lime by using ion exchange resin to remove calcium and magnesium ions in advance. Because performance of the ion exchange resin is deteriorated as the water softening process is performed, the ion exchange resin is regenerated by salt (NaCl) and reused. The water softening process by the ion exchange resin is represented as follows:

2(R—SONa)+Ca2<->(R—SO)Ca+2Na. The regenerating process is represented as follows: (R—SO)Ca+2NaCl<->2(R—SONa)+CaCl.

Figure 5:
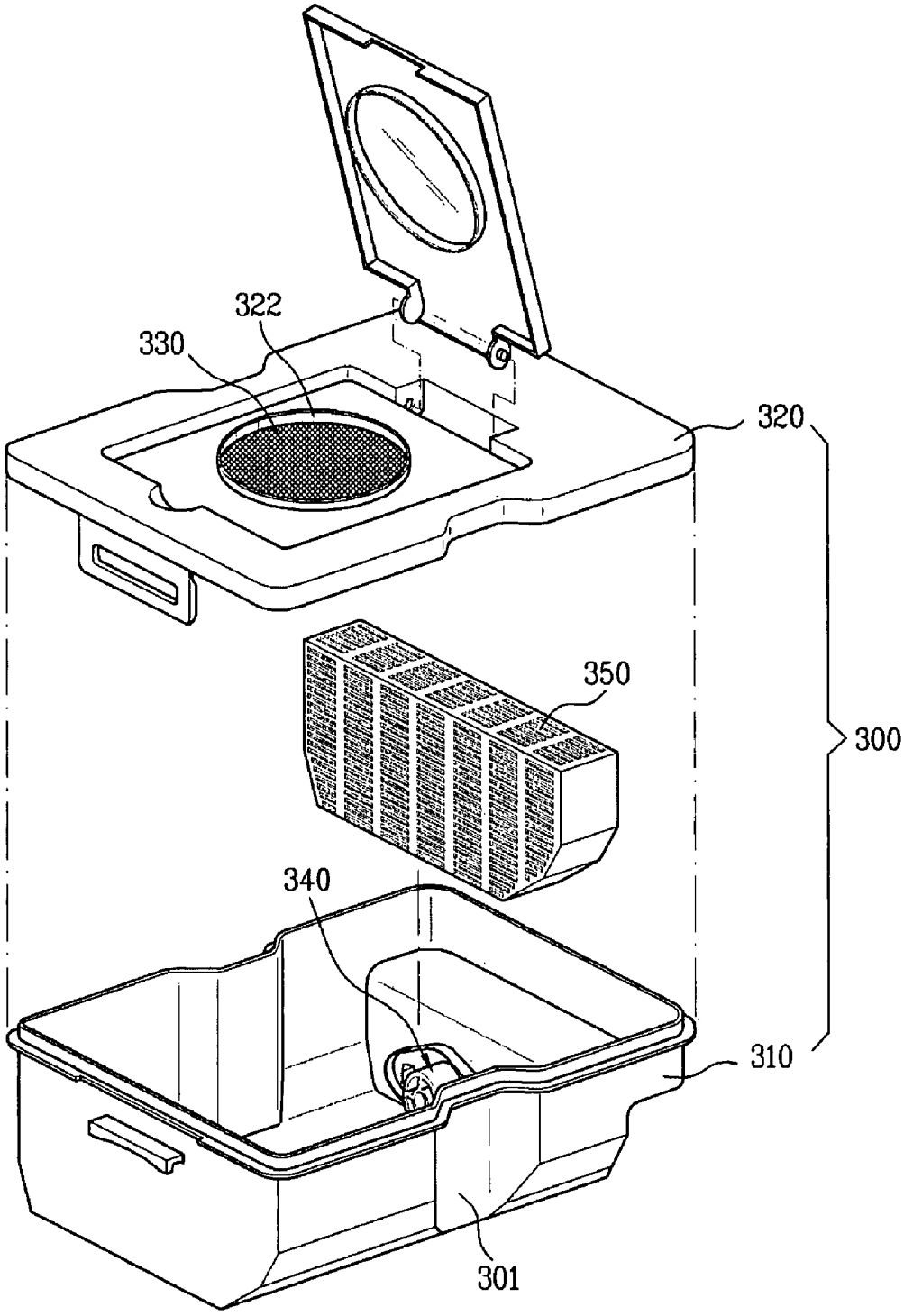
FIG. 5 is an exploded perspective view illustrating an example of a water supply source shown in FIG. 4.
Figure 6:
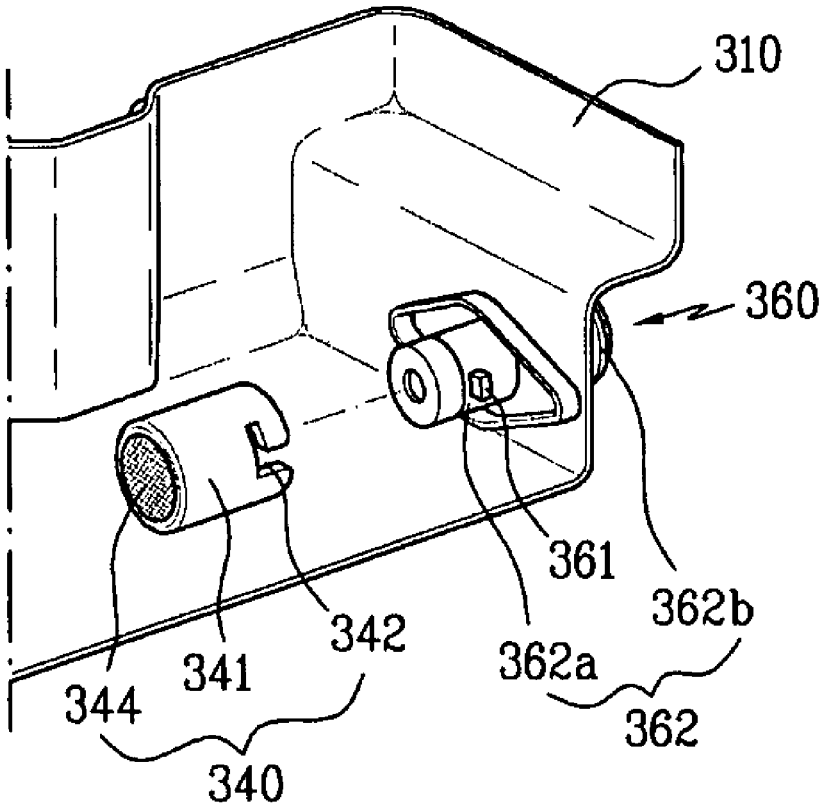
FIG. 6 is a partial perspective view illustrating a state of demounting a filter from the water supply source shown in FIG. 5.
Figure 7:
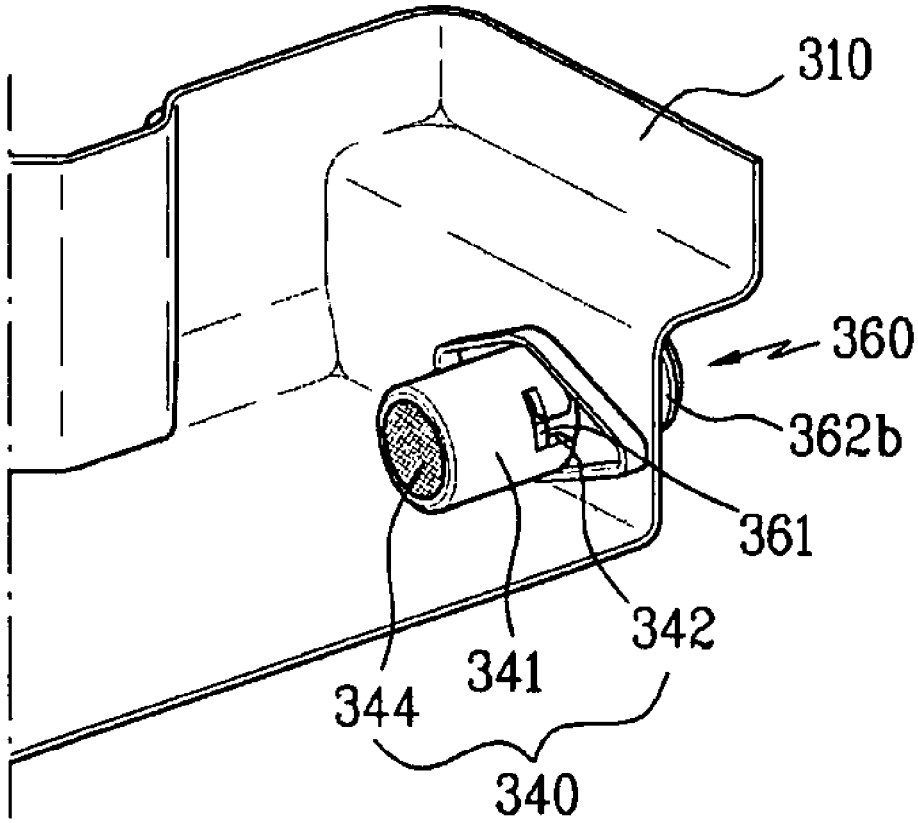
FIGS. 7 and 8 are partially cut perspective views illustrating a state of coupling the filter in FIG. 6.
Figure 8:
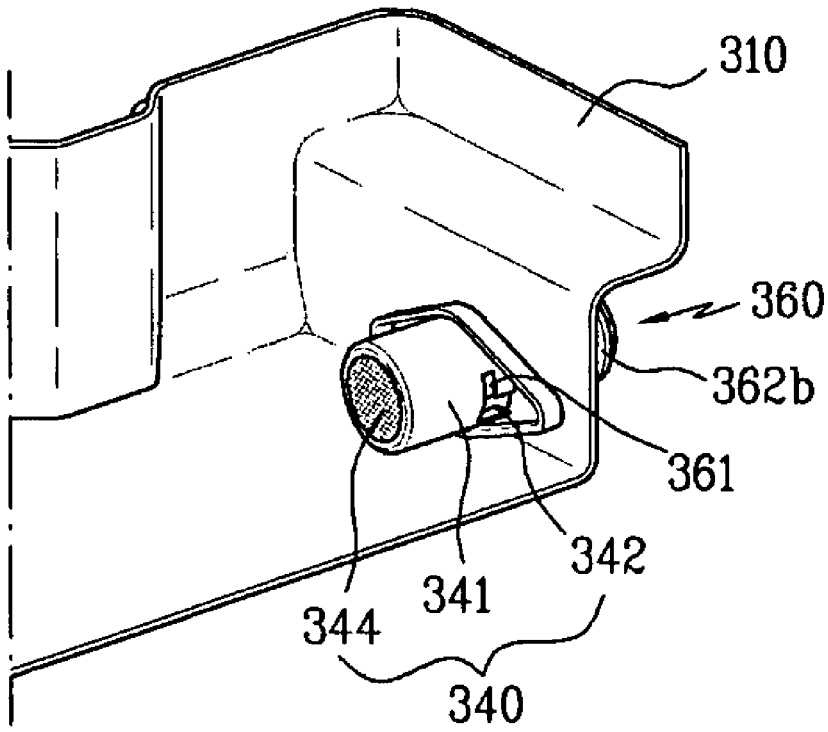

FIG. 6 is a partial perspective view illustrating a state of demounting the second filter 340 from the cartridge 300 shown in FIG. 5, and FIGS. 7 and 8 are partial perspective views illustrating a state of coupling the second filter 340 in FIG. 6. The mounting/demounting structure of the second filter 340 and the first opening/closing member 360 will now be described in detail with reference to FIGS. 6 to 8.

As shown in FIG. 6, the first opening/closing member 360 is provided at the lower housing 310 of the cartridge 300 to communicate the interior of the cartridge 300 with the exterior. The first opening/closing member 360 includes a first flow passage 362 communicating with the cartridge 300, and a first pin 365 (refer to FIG. 10) to selectively open and close the first flow passage 362.

The first flow passage 362 includes an inner flow passage 362*a* and an outer flow passage 362*b*. A latching protrusion 361 is formed on an outer surface of the inner flow passage 362*a*. The second filter 340 includes a case 341 having a shape corresponding to the inner flow passage 362*a*, and a filtering part 344 provided at a portion of the case 341. The case 341 is formed with a slot portion 342 at a position corresponding to the latching protrusion 361 of the inner flow passage 362*a*. The slot portion 342 is formed in an "L" shape including a horizontal portion and a vertical portion.

Accordingly, as shown in FIG. 7, the second filter 340 is located such that the latching protrusion 361 of the inner flow passage 362*a* is fitted into the horizontal portion of the slot portion 342 of the second filter 340. Then, as shown in FIG. 8, if the second filter 340 is rotated, the coupling of the second filter 340 and the first opening/closing member 360 is completed. Since a process of demounting the second filter 340 from the first opening/closing member 360 is performed in order reverse to the above, the detailed explanation thereof will be omitted.

Although the aforesaid embodiment has shown and described that the first filter 330, the second filter 340 and the water softening member 350 are mounted to the detachable cartridge 300, the present invention is not restricted thereto. For example, the present invention also can be applied to a configuration in which an external water tap is used as the water supply source 300. In such a case, it is preferred that at least one of the first filter 330, the second filter 340 and the water softening member 350 is mounted in a water supply passage connected to the steam generator 200. It is more preferred that the first filter 330, the second filter 340 and the water softening member 350 are detachably mounted. Also, the first filter 330, the second filter 340 and the water softening member 350 may be provided together in a single case, and the case itself may be detachably mounted in the water supply passage.

Figure 9:
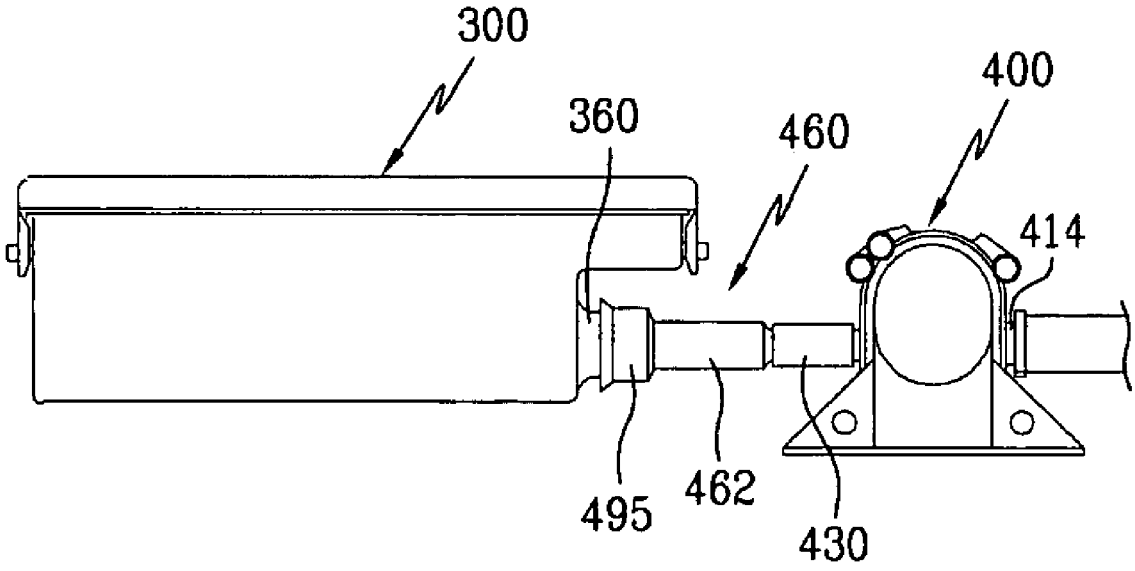
FIG. 9 is a side view illustrating a connecting structure between a pump and the water supply source shown in FIG. 4.

FIG. 9 is a side view illustrating the connecting structure of the cartridge 300 and the pump 400 shown in FIG. 4. The connecting structure of the cartridge 300 and the pump 400 will now be explained in detail with reference to FIG. 9.

As described above, the cartridge 300 is detachably mounted, and when the cartridge 300 is installed in the laundry dryer, the cartridge 300 is connected to the pump 400. At this time, a flow passage connecting the cartridge 300 and the pump 400 is formed. When mounting and demounting the cartridge 300, it is important to prevent water leakage from the connecting portion between the cartridge 300 and the pump 400. To this end, the steam laundry dryer of this embodiment includes an opening/closing member as a water leakage preventing unit which forms a flow passage to selectively pass water through the connecting portion between the cartridge 300 and the pump 400 and prevents water leakage. The opening/closing member may be mounted to at least any one of the cartridge 300 and the pump 400. However, the steam laundry dryer of this embodiment is constituted such that the opening/closing members are mounted to the cartridge 300 and the pump 400 one by one, which will be explained hereinafter.

Referring to FIG. 9, the cartridge 300 and the pump 400 are connected to each other through first and second opening/closing members 360 and 460. In other words, the flow passage connecting the cartridge 300 and the pump 400 is formed by coupling the first and second opening/closing members 360 and 460 to each other. Accordingly, the water in the cartridge 300 flows to the pump 400 via the first and second opening/closing members 360 and 460, and then flows to the steam generator 200 via the pump 400.

The connecting structure of the first and second opening/closing members 360 and 460 will now be explained in detail with reference to FIGS. 10 and 11.

As described above, the cartridge 300 is provided with the first opening/closing member 360 which selectively communicates with the exterior of the cartridge 300. The first opening/closing member 360 includes the first flow passage 362 and the first pin 365 to selectively open and close the first flow passage 362. The first flow passage 362 includes the inner flow passage 362*a* and the outer flow passage 362*b*. The outer flow passage 362*b* is provided with a sealing member 369 to prevent water leakage.

In this embodiment, the sealing member 369 extends perpendicular to an end portion of the outer flow passage 362*b*. Particularly, the sealing member 369 is configured as a rib type ring which extends perpendicular to the end portion of the outer flow passage 362*b* and has a predetermined thickness. The sealing member 369 and the first and second opening/closing members 360 and 460 doubly prevent water leakage, which will be described later. Also, by the sealing member 369, the coupling of the first and second opening/closing members 360 and 460 is easily achieved, and thus a user can experience a smooth feeling while manipulating the opening/closing members. The first and second opening/closing members 360 and 460 are further provided with a guide member to guide the coupling of the first and second opening/closing members 360 and 460, which will be described later.

Figure 12:
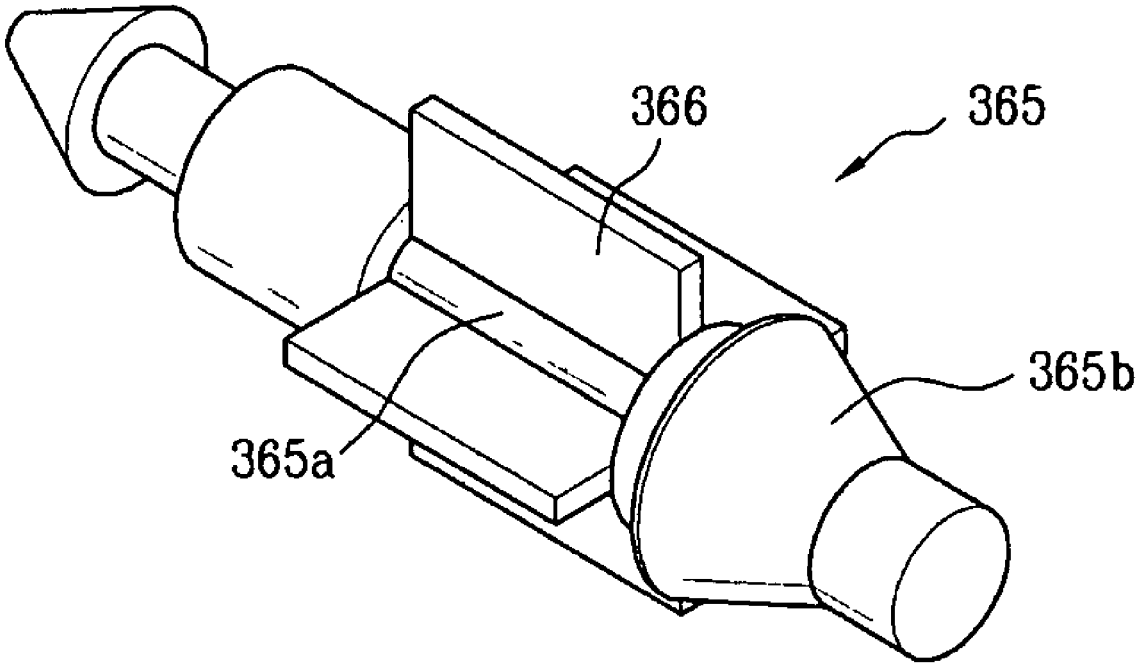
FIG. 12 is a perspective view illustrating a first pin.

The first pin 365 includes a moving part 365*a* and an opening/closing part 365*b* formed at an end of the moving part 365*a*. As shown in FIG. 12, the moving part 365*a* is formed in a substantially cross shape having cross-blades 366. Water flows through spaces between the cross-blades 366. Preferably, the opening/closing part 365*b* is made of a rubber material.

Referring again to FIG. 10, the first flow passage 362 includes the inner flow passage 362*a* which is protrudingly formed inwardly of the cartridge 300, and the outer flow passage 362*b* which communicates with the inner flow passage 362*a* and is protrudingly formed outwardly of the cartridge 300. The moving part 365*a* of the first pin 365 is supportedly mounted in the outer flow passage 362*b* by the cross-blades 366 (refer to FIG. 12). A spring 364 is provided between the moving part 365*a* of the first pin 365 and the inner flow passage 362*a*. The spring 364 applies an elastic force to the first pin 365, so that the opening/closing part 365*b* of the first pin 365 blocks the outer flow passage 362*b* when the cartridge 300 is not connected to the pump 400.

The second opening/closing member 460, which is selectively coupled to the first opening/closing member 360, is mounted to an inlet port 430 of the pump 400. The second opening/closing member 460 has a constitution corresponding to the first opening/closing member 360. In other words, the second opening/closing member 460 includes a second flow passage 462 connected to the pump 400, and a second pin 465 to selectively open and close the second flow passage 462.

The second flow passage 462 is connected to the inlet port 430 of the pump 400. A guide member 495 is mounted to an end portion of the second flow passage 462, adjacent to the cartridge 300, to guide the coupling of the first and second opening/closing members 360 and 460.

It is preferred that the guide member 495 has an expanded tube shape which is mounted to the end portion of the second flow passage 462 of the second opening/closing member 460 and is gradually increased in diameter. Although a center of the first opening/closing member 360 does not perfectly aligned with a center of the second opening/closing member 460, the first and second opening/closing members 360 and 460 can be easily and concentrically coupled to each other by the guide member 495 formed in the expanded tube shape.

Similarly to the first pin 365, the second pin 465 of the second opening/closing member 460 includes a moving part 465*a* and an opening/closing part 465*b* formed at an end portion of the moving part 465*a*. The moving part 465*a* is formed in a substantially cross shape having cross-blades. A spring 464 is provided between the moving part 465*a* of the second pin 465 and the inlet port 430 of the pump 400. When the cartridge 300 is not installed, the opening/closing part 465*b* of the second pin 465 blocks the second flow passage 462 by the spring 464.

Hereinafter, the coupling process of the first and second opening/closing members 360 and 460 will be explained in detail with reference to FIGS. 10 and 11.

Figure 10:
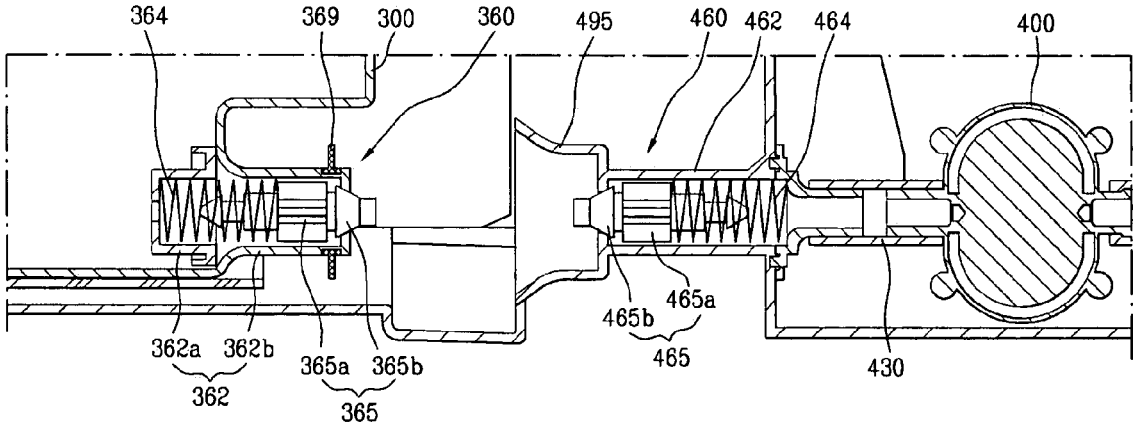
FIG. 10 is a partial sectional view illustrating a state of separating a first opening/closing member and a second opening/closing member from each other.

As shown in FIG. 10, when the cartridge 300 is separated from the second opening/closing member 460 connected to the pump 400, the opening/closing part 365*b* of the first pin 365 blocks the front end of the outer flow passage 362*b* by the first spring 364 of the first opening/closing member 360. Therefore, the water in the cartridge 300 does not flow outside through the first flow passage 362. Also in the second opening/closing member 460 connected to the pump 400, the opening/closing part 465*b* of the second pin 465 blocks the second flow passage 462 by the second spring 464.

Figure 11:
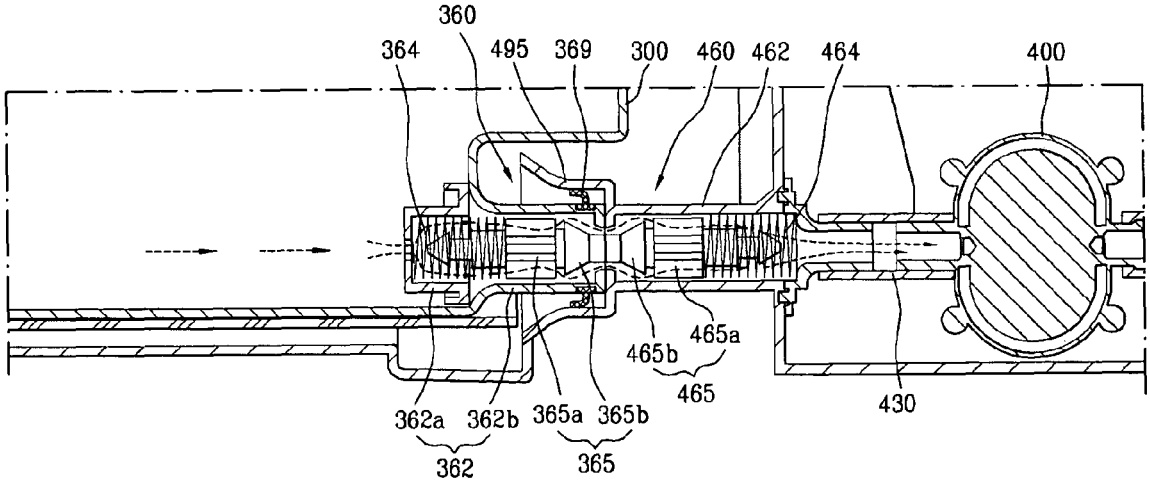
FIG. 11 is a partial sectional view illustrating a state of connecting the first opening/closing member and the second opening/closing member shown in FIG. 10.

As shown in FIG. 11, if the cartridge 300 is installed and the first and second opening/closing members 360 and 460 are coupled to each other, the first pin 365 and the second pin 465 push each other. Accordingly, the first pin 365 is pushed toward the inner flow passage 362*a* against the elastic force of the first spring 364, and the second pin 465 is pushed toward the pump 400 against the elastic force of the second spring 464. As a result, the opening/closing part 365*b* of the first pin 365 is separated from the front end of the outer flow passage 362*b* to form a gap therebetween, and the water flows out through the gap. As described above, since the moving part 365*a* of the first pin 365 is formed with cross-blades 366 (refer to FIG. 12), the water in the cartridge 300 flows through the spaces between the cross-blades 366, and is discharged outside the outer flow passage 362*b*.

The opening/closing part 465*b* of the second pin 465 is also separated from the front end of the second flow passage 462 to form a gap therebetween, and the water flowing out through the first opening/closing member 360 is supplied into the pump 400 via the second opening/closing member 460 through the gap. Since the moving part 465*a* of the second pin 465 is formed with cross-blades (not shown), the water discharged out of the first opening/closing member 360 flows into the pump 400 through the second flow passage 462 and the spaces between the cross-blades.

When the first and second opening/closing members 360 and 460 are coupled to each other, although the centers of the first and second opening/closing members 360 and 460 are not perfectly aligned, the first and second opening/closing members 360 and 460 can be easily coupled by the guide member 495 mounted to the end portion of the second opening/closing member 460. Also, since the sealing member 369 formed in the rib type ring is mounted to the end portion of the first opening/closing member 360, as shown in FIG. 11, when the first and second opening/closing members 360 and 460 are coupled to each other, an end portion of the sealing member 369 is bent by being contacted with the inner surface of the guide member 495, thereby securing the sealing between the first opening/closing member 360 and the second opening/closing member 460.

Although this embodiment has shown and described that the sealing member 369 is mounted to the first opening/closing member 360 and the guide member 495 is mounted to the second opening/closing member 460, the present invention is not restricted thereto. The guide member may be mounted to the first opening/closing member 360, and the sealing member may be mounted to the second opening/closing member 460. Alternatively, both the sealing member and the guide member may be mounted to any one of the first opening/closing member and the second opening/closing member.

Figure 13:
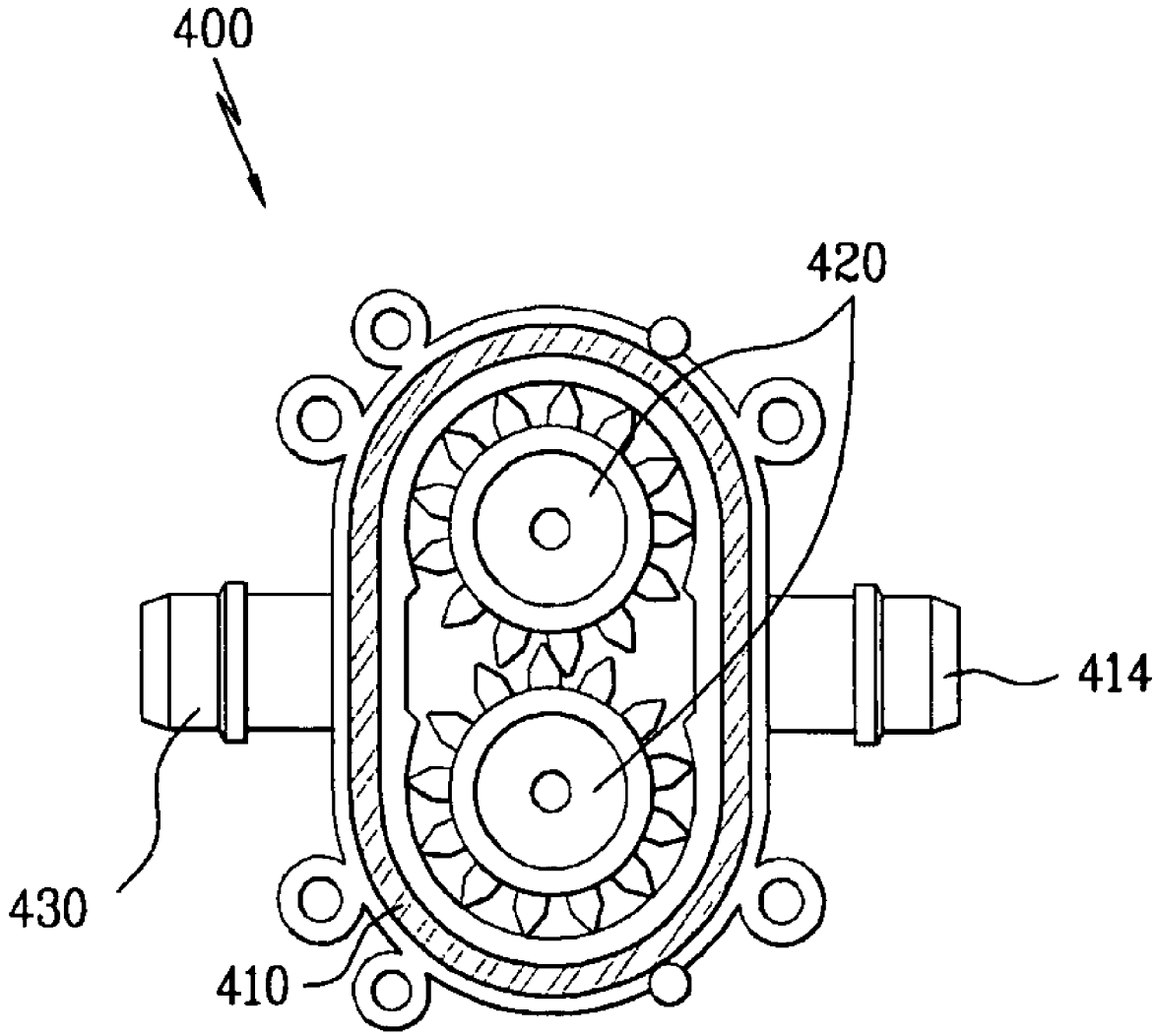
FIG. 13 is a sectional view schematically illustrating an example of the pump shown in FIG. 4.

FIG. 13 is a sectional view schematically illustrating an example of a pump according to the present invention.

Referring to FIG. 13, the pump 400 is employed to selectively supply water into the steam generator 200. It is preferred that the pump 400 can rotate in a forward direction and a reverse direction, so as to supply water into the steam generator 200 or collect water from the steam generator 200 as needed.

The pump 400 may be configured as a gear type pump, a pulsating type pump, or a diaphragm type pump. The pulsating type pump and the diaphragm type pump can control the flow of fluid in a forward direction and a reverse direction by changing polarities of a circuit momentarily as needed.

FIG. 13 illustrates a gear type pump as an example of the pump 400. The gear type pump 400 includes a case 410 and a pair of gears 420 provided in the case 410. The case 410 is provided with an inlet port 430 and an outlet port 414. According to a rotational direction of the gears 420, the water flows from the inlet port 430 to the outlet port 414 or from the outlet port 414 to the inlet port 430.

Figure 14:
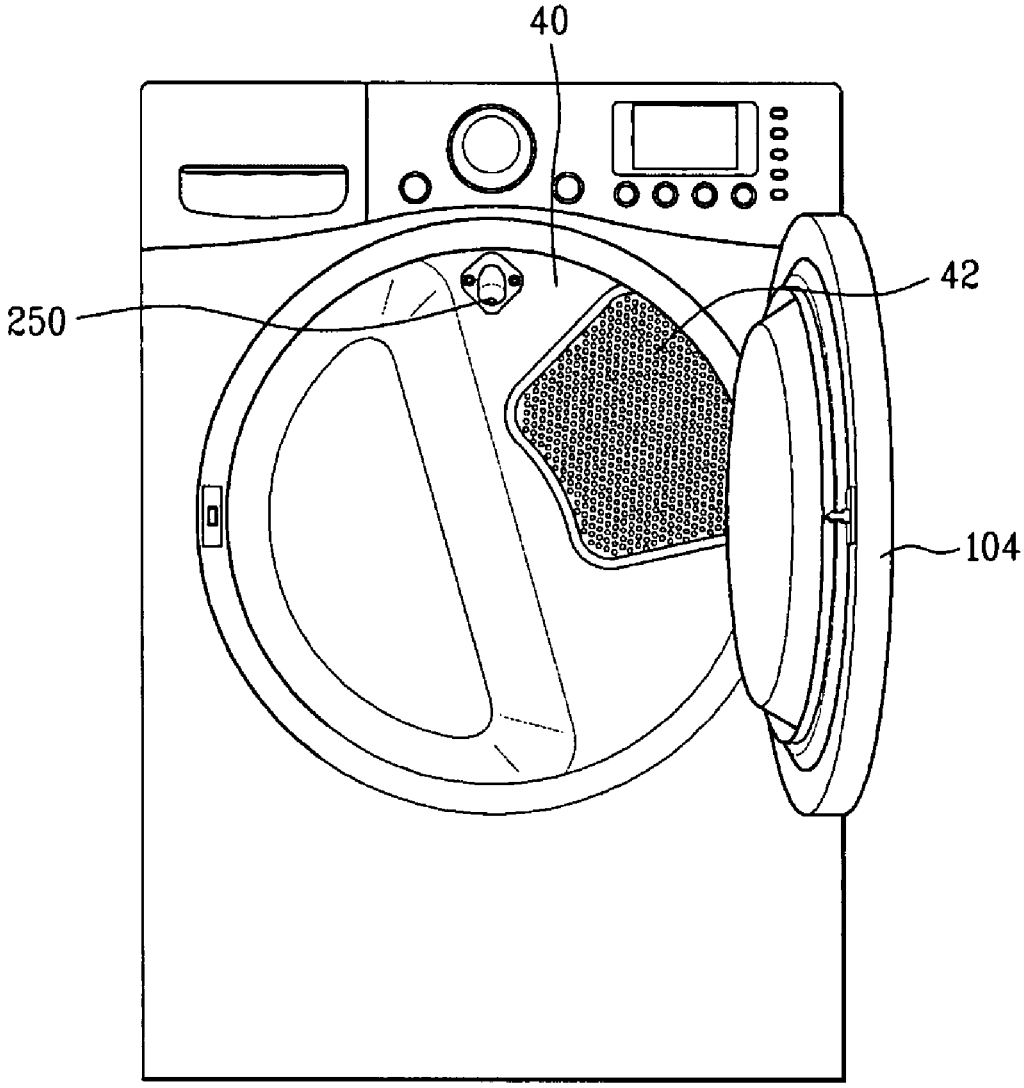
FIG. 14 is a front view illustrating a state of mounting a nozzle shown in FIG. 4.

FIG. 14 is a front view illustrating the steam laundry dryer mounted with the nozzle shown in FIG. 4.

Referring to FIG. 14, the nozzle 250 is mounted adjacent to the opening portion 42 for supplying hot air into the drum, so as to spray steam into the drum toward the front surface of the drum from the rear surface. The air is drawn into the drum through the opening portion 42 formed at the rear supporter 40 disposed at the rear of the drum, and then flows out to the lint duct 50 (refer to FIG. 1) provided under the door 104 disposed at the front of the drum. Accordingly, the air flow passage is defined substantially from the opening portion 42 to the lint duct 50. As a result, if the steam is sprayed toward the lower portion of the door 104 disposed at the front of the drum from the nozzle 250 mounted adjacent to the opening portion 42 disposed at the rear of the drum, the sprayed steam smoothly flows along the air flow passage, thereby evenly reaching the laundry in the drum.

The nozzle 250 explained in this embodiment can be applied to a laundry dryer without the detachable water supply source 300. For example, the nozzle 250 can be applied to a laundry dryer in which an external water tap is used as the water supply source 300.

Figure 15:
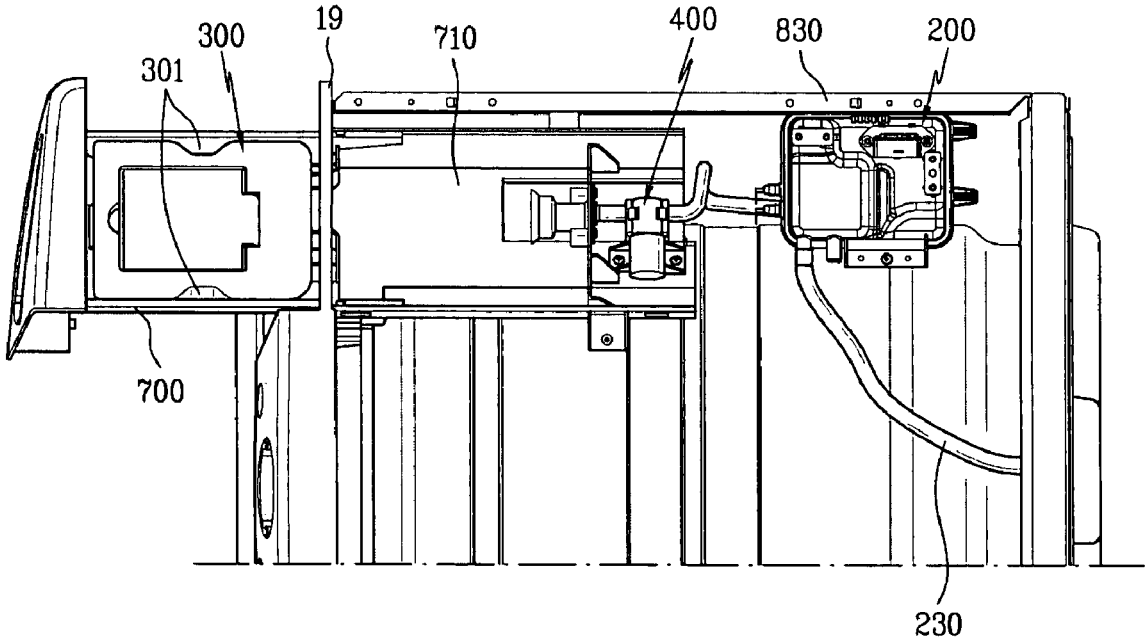
FIG. 15 is a perspective view illustrating a state of mounting components shown in FIG. 4.

The installation of the steam generator and other components of a steam line according to the present invention will now be explained with reference to FIG. 15.

A drawer type container 700 (hereinafter, referred to as "drawer") is drawably inserted into a predetermined portion of the steam laundry dryer. Preferably, the cartridge 300 is mounted in the drawer 700. In other words, it is preferable to mount the cartridge 300 in the drawer 700 and to indirectly connect/disconnect the cartridge 300 to/from the pump 400 by inserting/drawing the drawer 700, rather than to directly connect the cartridge 300 to the pump 400.

It is preferred that the drawer 700 is provided at the front surface of the steam laundry dryer, e.g., the control panel 19. A supporter 820 is mounted at the rear of the control panel 19. Particularly, the supporter 820 is mounted substantially parallel with a top frame 830, and a drawer guide 710 is mounted to the supporter 820 and the top frame 830 to guide and support the drawer 700. Although it is not illustrated in the drawings, it is preferable to provide a top guide at a portion of an upper portion of the drawer guide 710.

The upper portion and one side surface (at a direction of the front surface of the steam laundry dryer) of the drawer guide 710 are opened. The drawer 700 is inserted and drawn through the front opening portion of the steam laundry dryer, and the pump 400 is provided at an upper surface of the other side of the drawer guide 710.

As described above, it is preferable to mount the drawer 700 to the front surface of the laundry dryer from an aspect of convenience in use. FIG. 14 illustrates the laundry dryer in which the control panel 19 is mounted to the front cover, and the drawer 700 is inserted into and drawn out from the control panel 19. However, the present invention is not restricted thereto. For example, when the control panel is mounted to a top cover as shown in FIG. 1, it is possible to directly mount the drawer 700 to the front cover.

When it is designed such that the cartridge 300 is mounted in the drawer 700, it is preferred that at least both side surfaces of the cartridge 300 are shaped corresponding to both side surfaces of the drawer 700, so that the cartridge 300 is tightly coupled to the drawer 700. It is also preferred that both the side surfaces of the cartridge 300 is formed with concave portions 301 to facilitate the mounting/demounting of the cartridge 300.

Hereinafter, a process of supplying water into the cartridge 300 will be explained with reference to FIG. 15.

If a user draws out the drawer 700, the cartridge 300 is also drawn out therewith. Then, the user dismantles the cartridge 300 from the drawer 700. Water is supplied into the cartridge 300 through the water inlet 322 so that the cartridge 300 is filled with the water. The cartridge 300 filled with the water is mounted again in the drawer 700, and the drawer 700 is pushed in. The first opening/closing member 360 of the cartridge 300 is automatically connected to the second opening/closing member 460 connected to the pump 400, and the water in the cartridge 300 flows to the pump 400.

When the operation of the steam laundry dryer is completed, the cartridge 300 can be removed from the drawer 700. Since the cartridge 300 is composed of the upper housing 320 and the lower housing 310, it is easy to clean the removed cartridge 300.

Experimental results by this inventor show that the steam laundry dryer according to the present invention has an effect of removing and preventing wrinkles of laundry, although there is a difference according to the kinds of laundry, e.g., the kinds of cloths, hygroscopic properties, and the like. The object to be dried by the steam laundry dryer is generally the laundry dehydrated by a washing machine, however this is not restricted thereto. For example, the steam laundry dryer according to the present invention can remove wrinkles of the clothes that a user has worn for one day or more, i.e., the already dried clothes having few wrinkles. In other words, the steam laundry dryer according to the present invention also can be used as a kind of wrinkle-removing apparatus.

The steam laundry dryer according to the present invention may have the following advantageous effects.

First, wrinkles or crumples generated on the dried laundry can be effectively prevented or removed. Further, sterilization and deodorization of the dried laundry can be achieved.

Second, wrinkles or crumples of the clothes that are in a dried state, can be effectively removed without additional ironing.

Third, since water leakage is doubly prevented by the first and second opening/closing members when installing the cartridge, the water leakage in the steam laundry dryer can be effectively prevented.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a drum rotatably mounted in a cabinet;

a hot air heater to heat air and supply hot air into the drum;

a steam generator to supply steam into the drum;

a water supply source detachably mounted in the cabinet to supply water into the steam generator;

a pump to supply water into the steam generator, the water supply source detachably connected to the pump;

a water leakage preventing unit to prevent water leakage when the water supply source is mounted, the water leakage preventing unit preventing water leakage from a connection portion between the water supply source and the pump, wherein the water leakage preventing unit includes opening/closing members provided in the water supply source and the pump, the opening/closing members selectively passing water to prevent water leakage, wherein the opening/closing members include a first opening/closing member connected to the water supply source, and a second opening/closing member connected to the pump, wherein the first opening/closing member selectively communicates with an exterior to discharge water from the water supply source, and the second opening/closing member is selectively connected to the first opening/closing member to supply water from the water supply source to the pump; and wherein the first opening/closing member includes a first flow passage to communicate an interior of the water supply source with an exterior, and a first pin to selectively open and close the first flow passage.

2. The laundry machine according to claim 1, wherein the first pin selectively opens and closes the first flow passage by a first elastic member.

3. The laundry machine according to claim 2, wherein the second opening/closing member includes a second flow passage connected to the pump, and a second pin to selectively open and close the second flow passage.

4. The laundry machine according to claim 3, wherein the second pin selectively opens and closes the second flow passage by a second elastic member.

5. The laundry machine according to claim 4, wherein when the first opening/closing member and the second opening/closing member are connected to each other, the first pin and the second pin pushes each other in an opposite direction to open the first flow passage and the second flow passage.

6. The laundry machine according to claim 1, wherein the water leakage preventing unit further includes a sealing member formed at any one of the first opening/closing member and the second opening/closing member.

7. The laundry machine according to claim 6, wherein the sealing member is formed at an end portion of the first opening/closing member.

8. The laundry machine according to claim 7, wherein the sealing member extends perpendicular to the end portion of the first opening/closing member while having a predetermined thickness, and when the first opening/closing member and the second opening/closing member are connected to each other, an end portion of the sealing member is bent by being contacted with an inner surface of the second opening/closing member.

9. The laundry machine according to claim 1, further comprising:

a guide member mounted to any one of the first opening/closing member and the second opening/closing member to guide coupling of the first opening/closing member and the second opening/closing member.

10. The laundry machine according to claim 9, wherein the guide member is mounted to an end portion of the second opening/closing member.

11. The laundry machine according to claim 10, wherein the guide member has an expanded tube shape which is increased in diameter toward an end portion of the first opening/closing member.

12. A laundry machine comprising:

a drum rotatably mounted in a cabinet;

a hot air heater to heat air and supply hot air into the drum;

a steam generator to supply steam into the drum;

a water supply source filled with water to be supplied into the steam generator and detachably mounted in the cabinet; and a water leakage preventing unit to prevent water leakage when the water supply source is mounted wherein the water supply source is detachably connected to a pump.

13. The laundry machine according to claim 12, wherein the leakage preventing unit prevents water leakage from a connecting portion between the water supply source and the pump.

14. The laundry machine according to claim 13, wherein the water leakage preventing unit includes:

a first opening/closing member selectively communicates with an exterior of the water supply source to discharge water from the water supply source; and a second opening/closing member selectively connected to the first/opening/closing member to supply water from the water supply source to the pump.

15. The laundry machine according claim 14, further comprising:

a guide member mounted to any one of the first opening/closing member and the second opening/closing member to guide coupling of the first opening/closing member and the second opening/closing member.

* * * * *